US005147123A

United States Patent [19]

Berger

[11] Patent Number: 5,147,123

[45] Date of Patent: Sep. 15, 1992

[54] METAL PANEL FOR DRAWER WALLS

[75] Inventor: Horst Berger, Bielefeld, Fed. Rep. of Germany

[73] Assignee: Karl Lautenschläger GmbH & Co. KG, Reinheim, Fed. Rep. of Germany

[21] Appl. No.: 685,899

[22] Filed: Apr. 12, 1991

[30] Foreign Application Priority Data

Apr. 12, 1990 [DE] Fed. Rep. of Germany ..... 4011815

[51] Int. Cl.[5] ..... A47B 88/00

[52] U.S. Cl. ..... 312/348.1

[58] Field of Search ..... 312/348.1, 348.2, 330.1, 312/263, 330.1

[56] References Cited

U.S. PATENT DOCUMENTS

| | | | |
|---|---|---|---|
| 3,185,770 | 1/1940 | Larson | 312/330.1 |
| 3,820,299 | 6/1974 | Verholt | 312/330.1 X |
| 4,191,439 | 3/1980 | Cohen | 312/263 X |
| 4,875,746 | 10/1989 | Rock et al. | 312/263 X |

FOREIGN PATENT DOCUMENTS

| | | | |
|---|---|---|---|
| 2059870 | 6/1972 | Fed. Rep. of Germany | 312/263 |

*Primary Examiner*—Joseph Falk

[57] ABSTRACT

The present invention relates to a metal panel for drawer walls. The invention provides for a single thickness wall plate stamped and shaped from sheet metal and a separately manufactured drawer-bottom holding shaped structure formed of metal. The wall plate has a lower marginal area which the drawer bottom holding shaped structure is fastened to.

10 Claims, 1 Drawing Sheet

METAL PANEL FOR DRAWER WALLS

BACKGROUND OF THE INVENTION

The invention relates to a metal panel for drawer walls such as the vertical sides or the back of a drawer.

In certain applications in interior furnishings and furniture construction there has been in recent times an increasing use of drawers whose walls are made of plastic or metal structural shapes. Drawers are used having sides made from hollow metal structural shapes, especially the sides of large drawers of great capacity which are intended for the storage of heavy parts or objects, i.e., which are exposed to heavy loading. For example, structural shapes of light metal alloys are used which in addition to the required load-bearing capacity also have the advantage of light weight and, since they are made by extrusion, they can also be made with cross-sectional configurations which offer the possibility of a concealed arrangement of the hardware for assembling the walls, i.e., for joining the drawer sides to the drawer back and/or drawer fronts, for mounting the drawer bottom, and for concealing the runner of the matching drawer guide. Hollow metal structural shapes extruded from aluminum alloy, however, are comparatively expensive on account of the great cost of investment in the extruding equipment and dies. The invention is therefore addressed to the problem of creating a metal panel for drawer walls which, even if manufactured in comparatively small amounts, can be made at definitely lower cost than the known extruded light-metal stock material, without the need to accept any reduction in load-carrying capacity or any impairment of external appearance of the drawers made with the use of the metal panels.

This problem is solved in accordance with the invention by a single-thickness wall plate stamped and shaped from sheet metal, and by a separately manufactured drawer-bottom holding structural shape of metal fastened to the bottom marginal portion of the wall plate and extending substantially over the entire length of this bottom margin. The wall plate can be stamped very simply out of sheet metal, preferably sheet steel, and can then also be shaped in cross section by rolling or edging so as to achieve sufficient stiffening together with an attractive appearance.

The drawer-holding structural shape can then be an extruded or pressure-cast metal molding which has a coupling portion containing a slot running lengthwise in which the bottom margin of the wall plate is held, a flat, bottom-holding flange projecting at right angles from the coupling portion and an upper flange forming a cove running down from the inside surface of the wall plate to the upper surface of a corresponding drawer bottom. The bottom-holding structural shape thus accommodates the drawer bottom, consisting usually of a wooden board, between its bottom flange and the upper flange, and, due to its concave or cove shape, the upper flange provides a curving transition from the drawer wall down to the upper surface of the drawer bottom, which substantially facilitates the cleaning of the drawer.

The clearance between the lower, drawer-bottom holding flange and the upper flange is best made approximately equal to the thickness of a drawer bottom to be mounted between these flanges.

If a relatively thick drawer bottom is used, in whose edges facing the drawer slides a deep slot can be incorporated, the panel can be configured, in further development of the invention, such that an elongated anchoring rib projects at right angles from the coupling portion about centrally between the drawer-bottom holding flange and the transition flange, and this rib can be hammered or forced into the slot cut in the edge of the drawer bottom held between the flanges.

The anchoring rib then is best provided with serrations to dig into the walls of the slot when it is hammered or forced into it, and thus to assure the secure fastening of the drawer bottom to the walls of the drawer.

If an anchoring rib is not provided it may be desirable to have serrations or spurs projecting from the surface of the bottom flange that will face the drawer bottom when the latter is inserted between the drawer-bottom holding flange and the transitional flange. These spurs or serrations will then dig into the drawer bottom when the metal panel is assembled with the latter, and will thus perform the function of the serrations on the anchoring rib.

A masking flange projecting vertically downward from the bottom margin of the coupling portion can additionally be provided, which will conceal a runner of a corresponding drawer guide mounted under the drawer bottom.

The wall plate and the drawer-bottom mounting section can be joined together very simply by providing the bottom margin of the wall plate that is to be inserted into the longitudinal slot in the structural shape with a number of holes into which material can be driven from the coupling portion, resulting in an interlocking assembly of the wall plate unit and the drawer-bottom mounting section.

To assure that the above-described method of assembling the bottom structural shape to the wall plate will not detract from the appearance of the finished drawer, it is recommended that the material that is to be pressed into the holes in the bottom margin of the wall plate be driven into the respective holes from the surface of the coupling portion that faces the edge of the drawer bottom and is exposed in the area between the bottom flange and the upper flange. In the completed drawer this area is concealed by the drawer bottom so that the deformed portions of the structural shape will not be visible.

Instead of a bottom structural shape made from metal by extrusion or pressure casting, a structural shape made from sheet metal can serve as the metal structural shape in accordance with the invention. In a preferred embodiment of the invention the bottom structural shape is shaped lengthwise from a stirp of sheet metal of sufficient width and of a length correpsonding substantially to the length of the wall plate, such that a drawer-bottom holding flange will project at right angles from the bottom edge of a vertical coupling section which can be affixed to the inside surface of the bottom margin of the wall plate, and an upper flange forming a cove in cross section is provided at a distance above the bottom flange in the upper marginal portion of the coupling section.

In an advantageous embodiment of the invention, a flange projects at right angles from the upper edge of the coupling portion parallel to the bottom flange, and from its margin remote from the coupling portion the portion forming the cove is bent back upwardly and toward the inside surface of the wall plate. A further development is then advantageous in which a reinforcing flange is bent back from the upper edge of the cove toward and parallel to the coupling section.

In a preferred further development of the invention the reinforcing flange is made so wide tranversely of the length of the structural shape that its free bottom margin is approximately flush with the bottom edge of the coupling portion, and the confronting surfaces of the reinforcing flange and coupling portion lie against one another.

The free distance between the bottom flange and the flange parallel thereto which bears the cove portion can then be made equal to the thickness of a drawer bottom that is to be held between these flanges.

Alternatively, however, the free distance between the bottom flange and the flange parallel thereto which bears the cove portion can also be equal to the distance between the top side of the drawer bottom and a slot made in the edge of the drawer bottom facing the structural shape. In this case the bottom flange will not hold the drawer bottom at its underside but will be pushed or pressed into the slot. It is then again recommendable to provide barb-like projections or tongues on the bottom flange.

To enhance the load-carrying capacity of the bottom flange the latter can be formed from a flange bent at right angles from the coupling portion and a second flange doubled back 180 degrees onto the first.

The coupling portion of the bottom structural shape is attached by resistance welding, e.g., spot welding or rolling seam welding.

To enable the cove portion of the bottom structural shape to merge smoothly with the inside surface of the wall plate, provision is made in a further development according to the invention such that the wall plate is jogged on the width of the area in contact with the structural shape by the amount of the thickness of the coupling portion and, if desired, of the reinforcing flange of the structural shape, parallel to the area of the wall plate situated above it, in a direction away from the drawer bottom.

BRIEF DESCRIPTION OF THE DRAWINGS

The invention will be further explained in the following description of a number of embodiments in conjunction with the drawings wherein.

DETAILED DESCRIPTION

Figure 1:
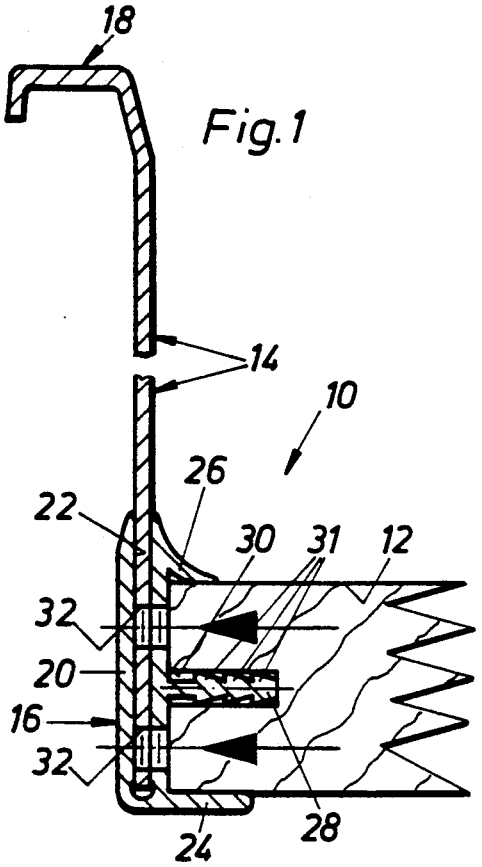
FIG. 1 is a fragmentary view through a first embodiment of a metal panel in accordance with the invention which in the case illustrated forms a drawer side, showing the area of attachment of the corresponding drawer bottom.

Let us say that the metal panel shown in section in FIG. 1 and identified as a whole by the number 10 is a drawer side 12 which is joined to a relatively thick drawer bottom 12 made of a wood-based board material. The panel 10 itself is composed of two parts, namely the wall plate 14 forming the actual drawer side and the separately made drawer-bottom mounting structural shape 16, the parts being joined permanently together in any appropriate manner.

The wall plate 14 is a structural section stamped from originally planar sheet metal and bent to the cross-sectional shape shown, or one that is continuously formed by rolling from a sheet-metal strip of the necessary width and cut to pieces of the desired length. In the case represented, a shaping action has been performed only at the upper margin of the sheet metal blank or strip, at 18, by first bending this upper margin outward and then downward to form a narrow, hooked structural shape. Such shaping stiffens the wall plate 14 and creates space under the hooked upper structural shape 18 to accommodate the runner of a drawer guide.

The bottom structural shape 16 in the case represented is a piece made preferably from a light-metal alloy by extrusion or pressure casting which has an elongated section 20 into the top of which a slot 22 is cut lengthwise, in which the bottom margin of the wall plate 14 can be inserted and then fastened in the manner yet to be described. The width of the slot 22 is approximately equal to the thickness of the sheet metal of the wall plate 14, so that the bottom margin of the latter is held therein in a substantially close-fitting manner.

From the botom end of the elongated section 20 an elongated drawer-bottom supporting flange 24 projects at right angles, reaching under the margin of the drawer bottom 12. A flange 26 reaches out from the upper margin of section 20 at a distance above flange 24, forming the cove-like shape which can be seen in the drawing, thus forming a curving transition between the inner surface of the wall plate and the drawer bottom 12. The clear distance between the bottom flange 24 and the upper flange 26 is made to correspond to the thickness of the drawer bottom 12 to be held between them.

To fasten the drawer bottom 12 to the panel 10 forming the drawer side, an anchoring rib 28 projects at right angles from section 20 approximately in the middle between the bottom flange 24 and the upper flange 26, and it can be hammered or pressed into the edge of a drawer bottom 12 to be held between the flanges, while serrations 31 on the upper and lower surfaces of the anchoring rib penetrate into the material of the drawer bottom, thus assuring a strong junction between the bottom flange 16 and the drawer bottom 12.

The permanent joining of the wall plate 14 to the structural shape 16 is brought about by punching holes 32 at equal intervals through the margin of the wall plate 14 that is held in the slot 22 in structural shape 16. After the wall plate 14 has been properly introduced into slot 22, material from the inside wall of section 20 is driven into the holes 32. In this manner the wall plate 14 is interlockingly joined to the structural shape 16 and cannot be removed from it without destroying it. Since the deformation of the material of the structural shape takes place only in the area between the bottom flange 24 and the upper flange 26, the deformations are invisibe after the drawer bottom 12 is installed, so that the appearance of an assembled drawer side made from the panel 10 is not impaired by this method of assembly.

Figure 2:
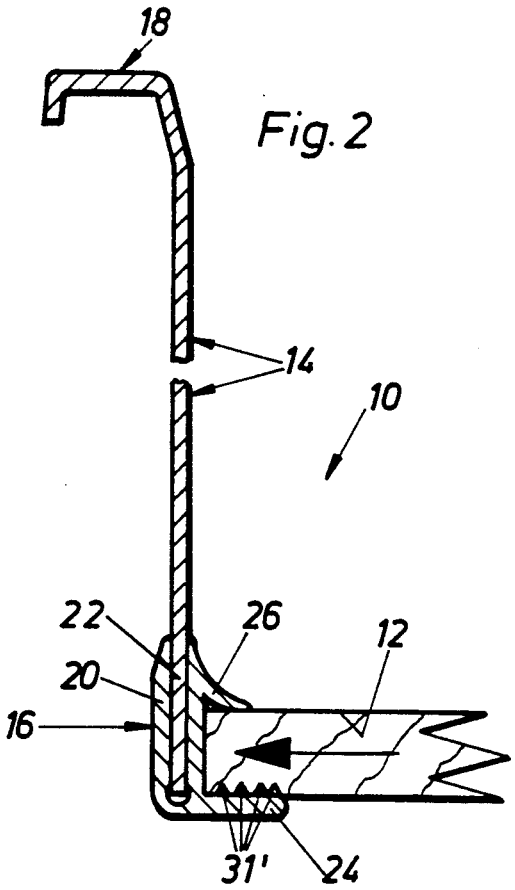
FIG. 2 is a sectional view of the same kind as in FIG. 1, taken through a modified embodiment of the metal drawer framing in accordance with the invention.

In FIG. 2 there is shown a metal panel 210 which is largely the same as the metal panel 210 described above in connection with FIG. 1, so that only the differences will be described herein. The metal panel is designed for use in conjunction with drawer bottoms 212 of lesser thickness, so that the space between the bottom flange 224 and the upper flange 226 of structural shape 216 is reduced accordingly. Anchoring the drawer bottom by means of the additional serrated anchoring rib is therefore impossible because the groove in the edge of the drawer bottom 212 would too greatly weaken the margins of the bottom. The secure anchoring of the bottom 212 is accomplished therefore in this case by means of sawtoothed ribs 31' on the upper side of the bottom flange 224 facing the underside of the drawer bottom 212.

Figure 3:
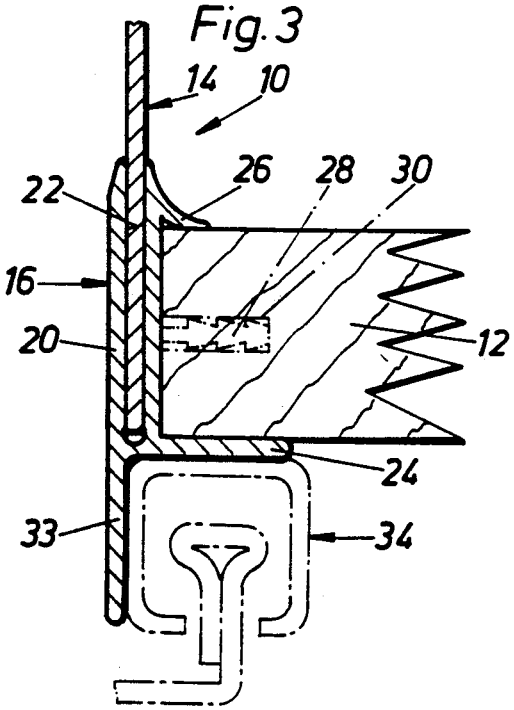
FIG. 3 is a sectional view through a third embodiment, in which the drawer-bottom mounting member is provided withy an additional, downwardly projecting mask for concealing a runner of a drawer guide, which is to be mounted on the bottom of the drawer.

The embodiment of panel 310 that is shown in FIG. 3 differs from the one in FIG. 1 only insofar as a masking flange 333 reaches downward from the bottom margin of section 320 parallel to the wall plate 314, its length being such that it covers the runner 334, indicated in phantom in the drawing, of a drawer guide mounted underneath the drawer.

Figure 4:
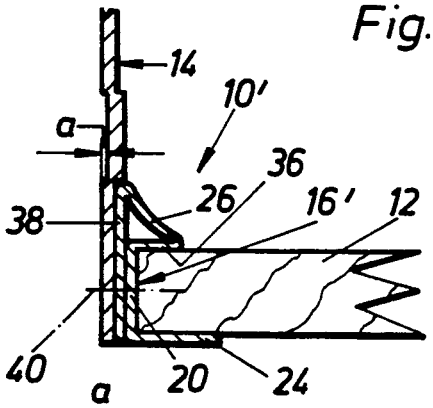
FIG. 4 is a sectional view of a fourth embodiment, in which the drawer-bottom mounting structural shape joined to the wall plate is formed from sheet metal.

Unlike the embodiments described above in conjunction with FIGS. 1 to 3, the structural shape 16' of the panel 10' shown in FIG. 4 (and FIG. 5) is not an extruded or pressure-cast part, but a sheet metal part bent to the cross-sectional shape shown in the drawing from a strip of sheet metal. This structural shape 16' also has a bottom flange 424 bent at right angles from section 20, and a flange 436 parallel thereto at a distance above it corresponding to the thickness of the drawer bottom 412; from the margin of flange 436 remote from section 420 the cove-forming portion 426 is bent back and upward against the inside surface of wall plate 414. From the upper margin of the cove-forming portion 426 in contact with the inside surface of the wall plate 414, a reinforcing portion 438 is bent toward and parallel to section 420, this reinforcing portion 438 being given such a width that its free bottom margin closes approximately flat against the bottom margin of section 420, and the confronting surfaces of the reinforcing portion 438 and of section 420 are in contact with one another. In their overlapping areas section 420 and the reinforcing portion 438 are joined together and to the inside surface of the wall plate 414, which is indicated in FIG. 4 by the dash-dotted horizontal line 440. This junction is best made by electrical resistance welding methods, e.g., electrical spot welding or rolling seam welding.

In order to achieve a largely gapless transition between the cove forming portion 426 and the wall plate 414, the latter is jogged in its lower marginal portion on the width of the areas in contact of the bottom structural shape 416 by an amount corresponding to the thickness of section 420 and, if desired, the reinforcing portion 438 is jogged away from the drawer bottom parallel to a section above it of the structural shape 414. The size of the jog a is indicated in the drawing on the side of wall plate 14 facing away from the drawer bottom.

Figure 5:
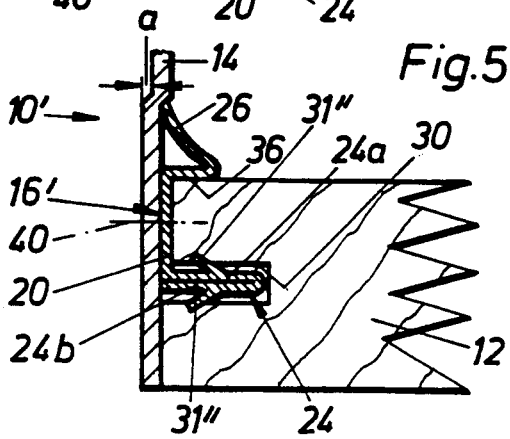
FIG. 5 is a sectional view through an additional variant embodiment of a metal panel with a drawer-bottom mounting structural shape formed from sheet metal.

The embodiment of the panel 10' shown in FIG. 5 also has a drawer-bottom holding flange 16' made from sheet metal, which differs from the embodiment seen in FIG. 4 in that no reinforcing portion corresponding to reinforcing portion 538 is provided, while the drawer-bottom holding flange 524 consists of two portions **24*a*, 24*b*, folded double on themselves. Barb-like projections or tongues 31'' are cut free and bent outwardly from both of the bottom-flange portions 24*a* and 24*b* and anchor the flange in a slot 530 in the drawer bottom 512. In this case the distance between the bottom flange 524 and the cove-like portion 26 of the upper flange 536 is not equal to the thickness of the drawer bottom 512 but equal to the distance between the slot 530 and the top of the drawer bottom 512**.

It is evident that modifications and further developments of the embodiments described can be made within the scope of the invention, relating both to the manner in which the drawer-bottom holding structural shape 16 is anchored on or in the drawer bottom 12. For example, the structural shape 16 can be joined to the wall plate 14 by cementing or by snap-fastening or riveting.

I claim:

1. A metal panel for drawer walls, comprising a wall plate (14) having a single-thickness and stamped and shaped from sheet metal and a separately made drawer-bottom holding shaped structure (16; 16') formed of metal, said wall plate having a lower marginal area which said drawer bottom holding shaped structure is fastened to and which extends substantially over an entire length of this bottom margin, said wall plate having a longitudinal slot and the drawer-bottom holding shaped structure (16) is a section of metal, which has coupling portion (20) comprising a longitudinal slot (22) into which is fitted the bottom margin of the wall place (14), a strip-like bottom holding flange (24) projecting at right angles from the coupling portion (20), and a transition flange (26) projecting at a distance above the bottom-holding flange forming a cove of concavely rounded cross section in an area of transition from an inside surface of the wall plate (14) to a top side of the corresponding drawer bottom (12), wherein the bottom-holding flange (24) and the transition flange (26) are spaced apart a distance approximately equal to a thickness of a drawer bottom (12) which is to be mounted between these flanges; and wherein about centrally between the bottom-holding flange (34) and the transition flange (26) a strip-like anchoring flange (28) projects at right angles from the coupling portion (20), adapted to be hammered into a slot-shaped groove (30) made in an edge surface of the drawer bottom (12) to be accommodated between the flanges (24, 26).

2. A panel according to claim 1, wherein the fastening flange has a cross section with anchoring ribs (31) projecting in a sawtooth-like manner.

3. A panel according to claim 2, wherein from the bottom edge of the coupling portion (20) a masking flange (33) projecting vertically downward parallel to the wall plate (14) is provided for concealing a runner (34) of a drawer guide.

4. A panel according to claims 1 or 2, wherein the wall plate (14) has a number of openings (32) in its bottom margin fitted into the longitudinal slot (22) in the bottom-holding section (16), into each of said number of openings material of the coupling portion (20) is deformed so as to fit therein.

5. A panel according to claim 4, wherein the material deformed into the openings (32) in the bottom margin of the wall plate (14) is pressed out from the surface of the coupling portion (26) that is exposed in an area between the bottom-holding flange (24) and the transition flange (26) which facing the edge surface of a drawer bottom (12) that is to be accommodated.

6. A panel according to any one of claim 3, wherein the wall plate (14) has a number of openings (32) in its bottom margin fitted into the longitudinal slot (22) in the bottom-holding section (16), into each of said number of openings material of the coupling portion (20) is deformed so as to fit therein.

7. A panel according to claim 1, wherein said drawer bottom holding shaped structure (16) is made of an extruded section of metal.

8. A panel according to claim 1, wherein said drawer bottom holding shaped structure (16) is made of a pressure-cast section of metal.

9. A panel according to claim 1, wherein said drawer bottom holding shaped structure (16) is made of a light metal alloy.

10. A metal panel for drawer walls, comprising a wall plate (14) having a single-thickness and stamped and shaped from sheet metal and a separately made drawer-bottom holding shaped structure (16; 16') formed of metal, said wall plate having a lower marginal area which said drawer bottom holding shaped structure is fastened to and which extends substantially over an entire length of this bottom margin, said wall plate having a longitudinal slot and the drawer-bottom holding shaped structure (16) is a section of metal, which has coupling portion (20) comprising a longitudinal slot (22) into which is fitted the bottom margin of the wall place (14), a strip-like bottom holding flange (24) projecting at right angles from the coupling portion (20), and a transition flange (26) projecting at a distance above the bottom-holding flange forming a cove of concavely rounded cross section in an area of transition from an inside surface of the wall plate (14) to a top side of the corresponding drawer bottom (12), wherein the bottom-holding flange (24) and the transition flange (26) are spaced apart a distance approximately equal to a thickness of a drawer bottom (12) which is to be mounted between these flanges; and wherein about centrally between the bottom-holding flange (34) and the transition flange (26) a strip-like anchoring flange (28) projects at right angles from the coupling portion (20), adapted to be pressed into a slot-shaped groove (30) made in an edge surface of the drawer bottom (12) to be accommodated between the flanges (24, 26).

* * * * *